US011414108B2

(12) United States Patent
Carter, Jr. et al.

(10) Patent No.: US 11,414,108 B2
(45) Date of Patent: Aug. 16, 2022

(54) RAILROAD SWITCH CIRCUIT CONTROLLER ASSEMBLY

(71) Applicant: L&W Industries, LLC, Springfield, MO (US)

(72) Inventors: Frank S. Carter, Jr., Ash Grove, MO (US); Stacey E. Ogden, Lebanon, MO (US)

(73) Assignee: L&W Industries, LLC, Springfield, MO (US)

( * ) Notice: Subject to any disclaimer, the term of this patent is extended or adjusted under 35 U.S.C. 154(b) by 320 days.

(21) Appl. No.: 16/709,878

(22) Filed: Dec. 10, 2019

(65) Prior Publication Data

US 2020/0180666 A1 Jun. 11, 2020

Related U.S. Application Data

(60) Provisional application No. 62/777,738, filed on Dec. 10, 2018.

(51) Int. Cl.
*B61L 5/02* (2006.01)
*B61L 5/10* (2006.01)
*B61L 5/06* (2006.01)

(52) U.S. Cl.
CPC ..... *B61L 5/026* (2013.01); *B61L 5/062* (2013.01); *B61L 5/065* (2013.01); *B61L 5/102* (2013.01); *B61L 5/107* (2013.01)

(58) Field of Classification Search
CPC .... B61L 5/10; B61L 5/02; B61L 5/026; B61L 5/062; B61L 5/065; B61L 5/102;
(Continued)

(56) References Cited

U.S. PATENT DOCUMENTS 1,455,996 A * 5/1923 Einstein ..... B61L 5/026 246/450
4,860,978 A * 8/1989 Durchschlag ..... B61L 5/00 246/448

(Continued)

OTHER PUBLICATIONS

Rail Development Group, "SC-100 Switch Circuit Controller," Retrieved at: http://www.raildev.com/sc100.html on Nov. 10, 2019, 1 page.

*Primary Examiner* — Zachary L Kuhfuss
*Assistant Examiner* — Cheng Lin

(57) ABSTRACT

A railroad switch circuit controller assembly includes a switch frame configured to be mounted to a stock rail, and a switch controller held by the switch frame. The switch controller includes at least one switching mechanism. The switch controller includes a point detection rod operatively connected to the at least one switching mechanism. The point detection rod extends a length from a proximate end portion to a distal end portion. The proximate end portion of the point detection rod is located closer to the stock rail as compared to the distal end portion when the switch frame is mounted to the stock rail. The railroad switch circuit controller assembly also includes a switch foot configured to be mounted to a switch rail, and an external rod operatively connected between the switch foot and the point detection rod of the switch controller such that the external rod is configured to translate linear movement of the switch foot toward and away from the stock rail to the point detection rod. The external rod is connected to the proximate end portion of the point detection rod.

20 Claims, 10 Drawing Sheets

(58) Field of Classification Search
CPC ... B61L 5/107; E01B 7/00; E01B 7/02; E01B 7/06; E01B 7/08; E01B 2202/00; E01B 2202/02
See application file for complete search history.

(56) References Cited

U.S. PATENT DOCUMENTS

| | | | | |
|---|---|---|---|---|
| 7,168,662 | B1 * | 1/2007 | McQuistian | B61L 5/02 246/162 |
| 8,985,526 | B2 * | 3/2015 | Brushwood | B61L 5/107 246/430 |
| 9,090,268 | B2 * | 7/2015 | Bohme | E01B 7/02 |
| 9,863,096 | B2 * | 1/2018 | Arnold | E01B 7/20 |
| 2018/0354533 | A1 * | 12/2018 | Palozzi | B61L 5/10 |
| 2019/0351922 | A1 * | 11/2019 | Spohr | B61L 5/026 |

* cited by examiner

RAILROAD SWITCH CIRCUIT CONTROLLER ASSEMBLY

BACKGROUND

This Application claims priority to and the benefit of U.S. Provisional Patent Application Ser. No. 62/777,738, filed on Dec. 10, 2018 and entitled "RAILROAD SWITCH CIRCUIT CONTROLLER," which is incorporated herein by reference in its entirety.

BACKGROUND

Railroad switch assemblies often include switch circuit controller assemblies that detect the position of the railroad switch and whether the railroad switch has completely set and locked in the position. Switch circuit controller assemblies typically include a switch frame that is mounted to the stock rail of a railroad and a switch controller held by the switch frame. The switch controller includes a point detection rod (sometimes referred to as an "operating rod") that is operatively connected to one or more switching mechanisms (e.g., relays, switches, cams, etc.) that indicate the position of the railroad switch. An external rod is operatively connected between the point detection rod and a switch foot mounted to a switch rail (sometimes referred to as a "point") for translating linear movement of the switch foot between the positions of the railroad switch to the point detection rod.

However, at least some known external rods are operatively connected between the point detection rod and the switch foot using a plurality of linkages, connection points, and/or the like (e.g., linking rods, articulating joints, etc.) that may add slop (e.g., play, etc.) within to the operative connection of the external rod between the switch foot and the point detection rod. In other words, the linkages, connection points, and/or the like add numerous points of loss as the motion of the switch foot is translated to the point detection rod of the switch controller. Some known switch circuit controller assemblies may have as many as three or more points of loss. Such points of loss may require relatively frequent adjustment and/or may increase the loss of motion over time, which may increase the cost of maintaining the railroad switch, decrease the reliability of the railroad switch, and/or the like.

Further, the external rod of at least some known switch circuit controller assemblies is routed underneath the switch frame such that the profile of the switch controller may be exposed to dragging equipment and/or such that the external rod may be exposed to ballast between the railroad ties, which may interfere with operation of the switch circuit controller assembly and/or damage one or more components thereof (e.g., the switch controller, the external rod, etc.). Moreover, at least some known switch circuit controller assemblies are susceptible to damage caused by vertical movement of the rails (e.g., vertical pumping motion as rail cars move over the rails, which is sometimes referred to as "rail hump", etc.) and/or rail run (e.g., thermodynamic growth of the length of a railroad rail, etc.).

SUMMARY

In one aspect, a railroad switch circuit controller assembly includes a switch frame configured to be mounted to a stock rail, and a switch controller held by the switch frame. The switch controller includes at least one switching mechanism. The switch controller includes a point detection rod operatively connected to the at least one switching mechanism.

The point detection rod extends a length from a proximate end portion to a distal end portion. The proximate end portion of the point detection rod is located closer to the stock rail as compared to the distal end portion when the switch frame is mounted to the stock rail. The railroad switch circuit controller assembly also includes a switch foot configured to be mounted to a switch rail, and an external rod operatively connected between the switch foot and the point detection rod of the switch controller such that the external rod is configured to translate linear movement of the switch foot toward and away from the stock rail to the point detection rod. The external rod is connected to the proximate end portion of the point detection rod.

In another aspect, a railroad switch assembly includes a switch rail and a switch circuit controller assembly. The switch circuit controller assembly includes a switch frame configured to be mounted to a stock rail of a railroad, and a switch controller held by the switch frame. The switch controller includes at least one switching mechanism. The switch controller includes a point detection rod operatively connected to the at least one switching mechanism. The point detection rod extends a length from a proximate end portion to a distal end portion. The proximate end portion of the point detection rod is located closer to the stock rail as compared to the distal end portion when the switch frame is mounted to the stock rail. The switch circuit controller assembly includes a switch foot mounted to a switch rail, and an external rod operatively connected between the switch foot and the point detection rod of the switch controller such that the external rod is configured to translate linear movement of the switch foot toward and away from the stock rail to the point detection rod. The external rod is connected to the proximate end portion of the point detection rod.

In another aspect, a railroad switch circuit controller assembly includes a switch frame configured to be mounted to a stock rail, and a switch controller held by the switch frame. The switch controller includes at least one switching mechanism. The switch controller includes a point detection rod operatively connected to the at least one switching mechanism. The railroad switch circuit controller assembly also includes a switch foot configured to be mounted to a switch rail, and an external rod operatively connected between the switch foot and the point detection rod of the switch controller such that the external rod is configured to translate linear movement of the switch foot toward and away from the stock rail to the point detection rod. The external rod extends within an interior cavity of the switch frame.

DETAILED DESCRIPTION

Figure 1:
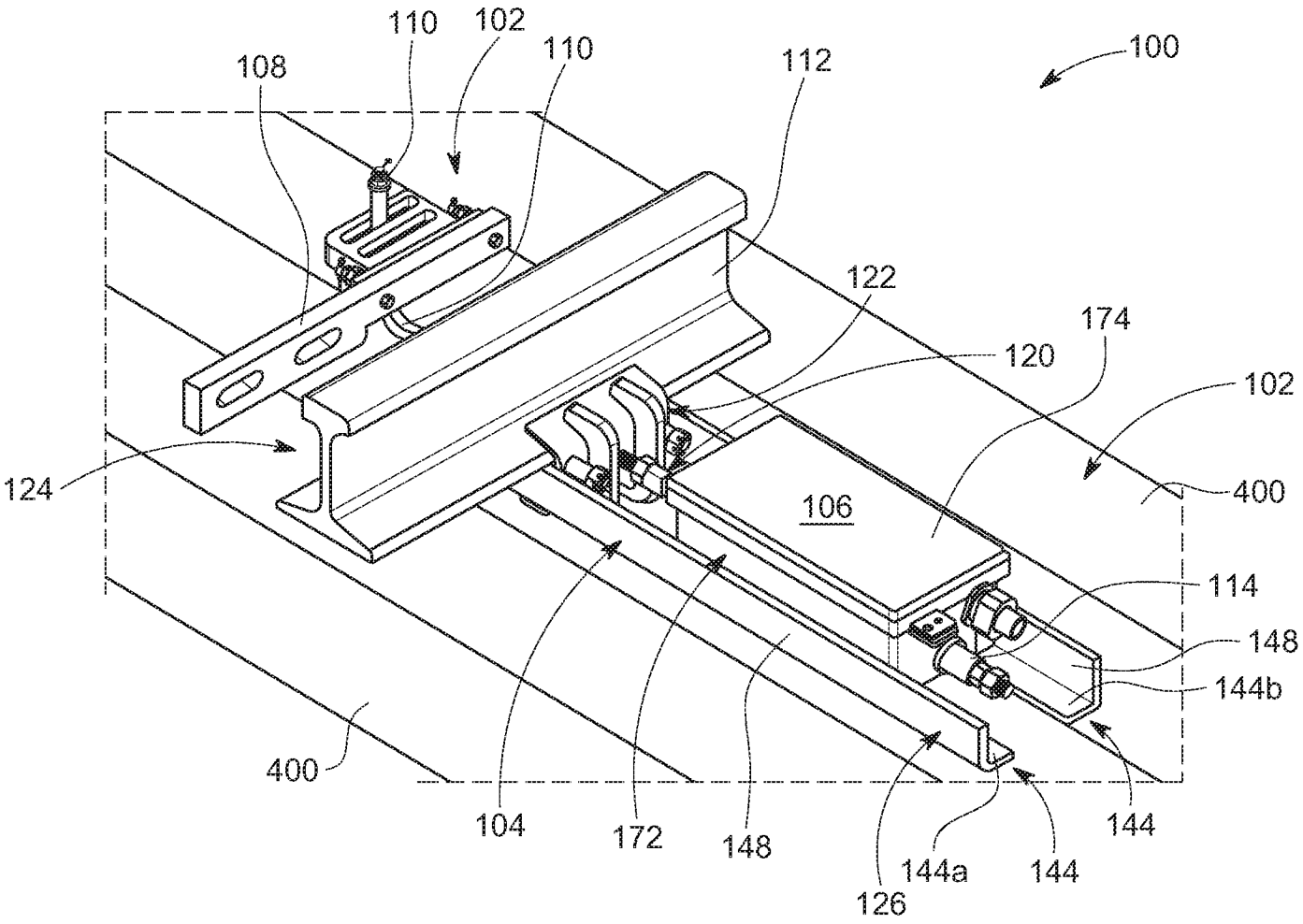
FIG. 1 is a perspective view of a portion of a railroad switch according to an implementation.

The foregoing summary, as well as the following detailed description of certain embodiments and implementations will be better understood when read in conjunction with the appended drawings. As used herein, an element or step recited in the singular and preceded by the word "a" or "an" should be understood as not necessarily excluding the plural of the elements or steps. Further, references to "one embodiment" or "one implementation" are not intended to be interpreted as excluding the existence of additional embodiments or implementations that also incorporate the recited features. Moreover, unless explicitly stated to the contrary, embodiments "comprising" or "having" an element or a plurality of elements having a particular property can include additional elements not having that property.

While various spatial and directional terms, such as "top," "bottom," "upper," "lower," "vertical," and the like are used to describe embodiments and implementations of the present disclosure, it is understood that such terms are merely used with respect to the orientations shown in the drawings. The orientations can be inverted, rotated, or otherwise changed, such that a top side becomes a bottom side if the structure is flipped 180 degrees, becomes a left side or a right side if the structure is pivoted 90 degrees, and the like.

Certain implementations of the present disclosure include a railroad switch circuit controller assembly that includes a switch frame configured to be mounted to a stock rail, and a switch controller held by the switch frame. The switch controller includes at least one switching mechanism. The switch controller includes a point detection rod operatively connected to the at least one switching mechanism. The point detection rod extends a length from a proximate end portion to a distal end portion. The proximate end portion of the point detection rod is located closer to the stock rail as compared to the distal end portion when the switch frame is mounted to the stock rail. The railroad switch circuit controller assembly also includes a switch foot configured to be mounted to a switch rail, and an external rod operatively connected between the switch foot and the point detection rod of the switch controller such that the external rod is configured to translate linear movement of the switch foot toward and away from the stock rail to the point detection rod. The external rod is connected to the proximate end portion of the point detection rod.

Certain implementations of the present disclosure provide a railroad switch circuit controller assembly that includes a switch frame configured to be mounted to a stock rail, and a switch controller held by the switch frame. The switch controller includes at least one switching mechanism. The switch controller includes a point detection rod operatively connected to the at least one switching mechanism. The railroad switch circuit controller assembly also includes a switch foot configured to be mounted to a switch rail, and an external rod operatively connected between the switch foot and the point detection rod of the switch controller such that the external rod is configured to translate linear movement of the switch foot toward and away from the stock rail to the point detection rod. The external rod extends within an interior cavity of the switch frame.

Certain implementations of the present disclosure reduce the number of points of loss (e.g., slop, play, etc.) between a switch foot and a point detection rod, which may reduce the amount of adjustment required over time, reduce the loss of motion over time, and/or the like. For example, certain implementations of the present disclosure reduce linkages, connection points, and/or the like (e.g., linking rods, articulating joints, etc.) between the switch foot and the point detection rod that can require adjustment, can increase the loss of motion over time, and/or the like. Certain implementations of the present disclosure lower the profile of a switch circuit controller assembly, which may reduce or eliminate the impact of dragging equipment interfering with and/or damaging the switch controller. Certain implementations of the present disclosure may reduce exposure of the external rod to ballast between the railroad ties, which may reduce or eliminate the impact of ballast interfering with and/or damaging the external rod. Certain implementations of the present disclosure accommodate at least some vertical movement of railroad rails (e.g., vertical pumping motion sometimes referred to as "rail hump", etc.), which may reduce or eliminate damage to the switch controller, an external rod, a switch foot, and/or other components of the switch circuit controller assembly caused by such vertical movement. Certain implementations of the present disclosure accommodate at least some rail run (e.g., thermodynamic growth of the length of a railroad rail, etc.), which may reduce or eliminate damage to the switch controller, an external rod, a switch foot, and/or other components of the switch circuit controller assembly caused by rail run.

Figure 2:
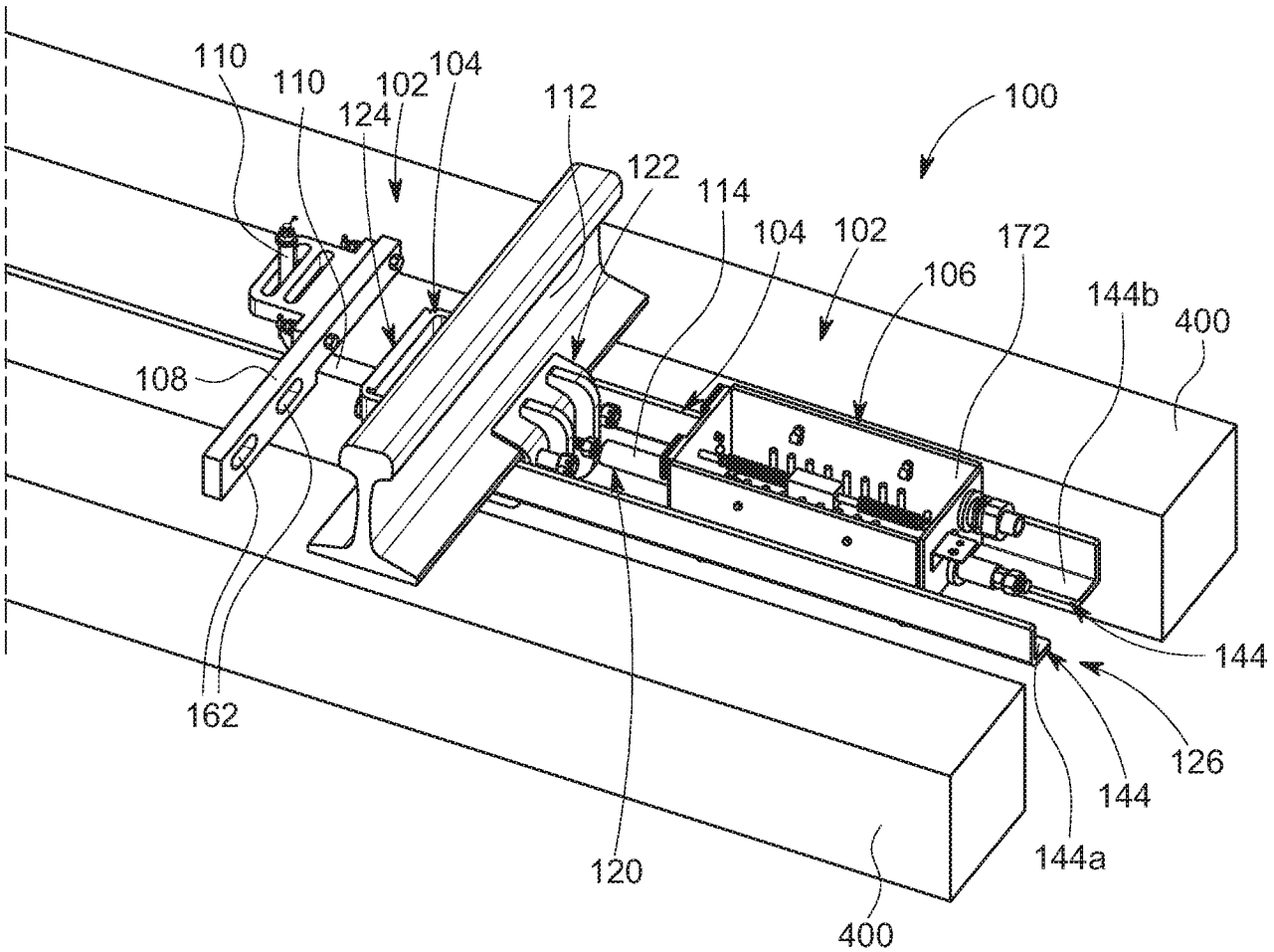
FIG. 2 is another perspective view of the railroad switch shown in FIG. 1 illustrating a switch circuit controller assembly of the railroad switch according to an implementation.
Figure 3:
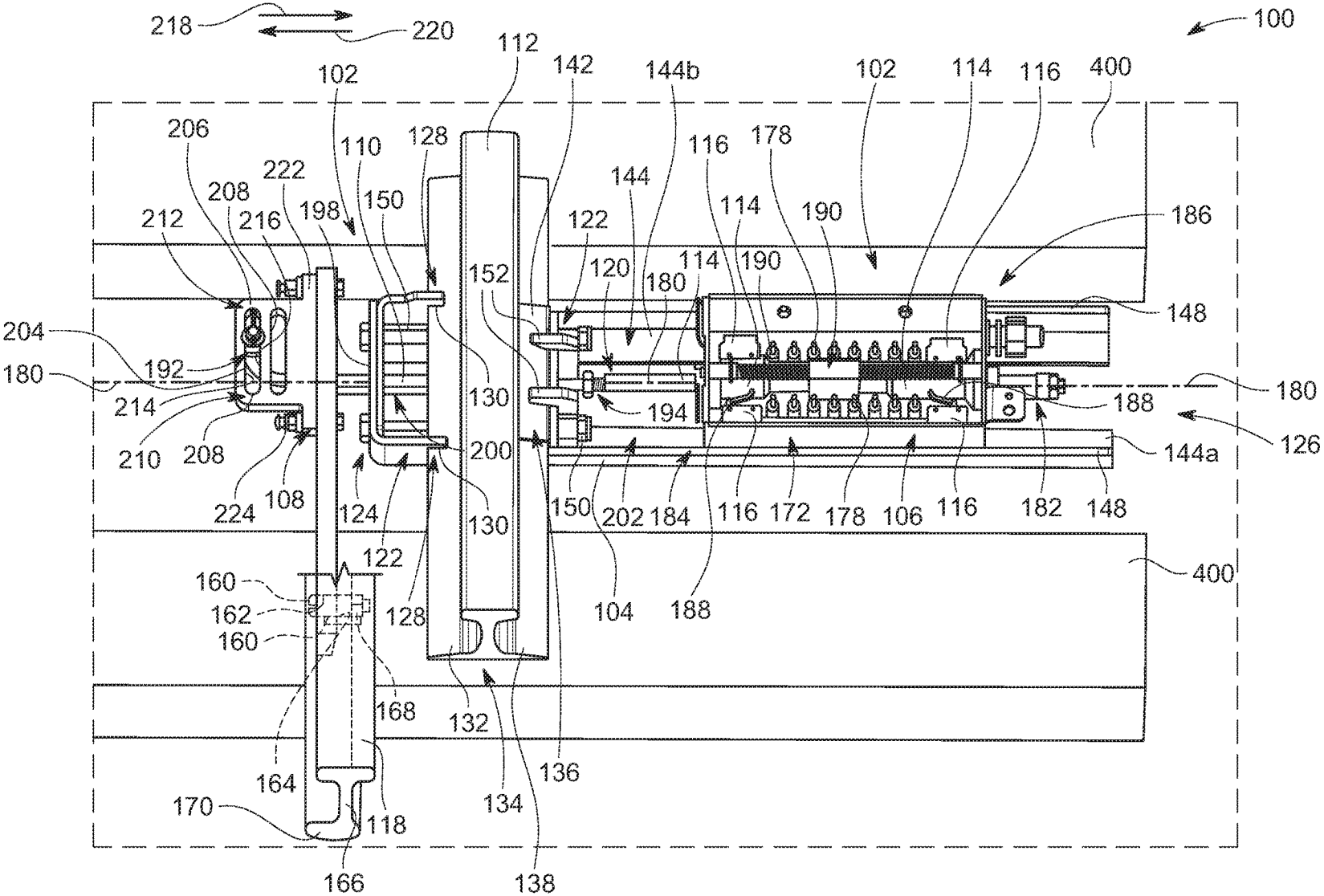
FIG. 3 is a perspective view of the railroad switch shown in FIGS. 1 and 2 illustrating a plan view of the railroad switch.

With references now to FIGS. 1-3, a railroad switch assembly 100 includes a switch circuit controller assembly 102 that is configured to detect the position of a railroad switch (not shown) of the assembly 100 and whether the railroad switch has completely set and locked in the particular position. The switch circuit controller assembly 102 includes a switch frame 104, a switch controller 106, a switch foot 108 (sometimes referred to as a "point lug"), and an external rod 110. As will be described below, the switch frame 104 is configured to be mounted to a stock rail 112 of a railroad, for example as is shown in FIGS. 1-5, 7, and 8, etc. The switch controller 106 is held by the switch frame 104 (e.g., as shown in FIGS. 1-4, 6, and 7, etc.) and includes a point detection rod 114 (sometimes referred to as an "operating rod") and one or more switching mechanisms 116 (not visible in FIGS. 1 and 2) that indicate the position of the railroad switch. The switch foot 108 is configured to be mounted to a switch rail 118 (sometimes referred to as a "point"; not shown in FIGS. 1 and 2) of the railroad switch assembly 100 (e.g., as shown in FIG. 3, etc.). The external rod 110 is operatively connected between the switch foot 108 and the switch controller 106, for example as is shown herein and described in more detail below, etc.

In operation, the switch foot 108 moves along with the switch rail 118 as the switch rail 118 moves between different positions of the railroad switch. The external rod 110 translates linear movement of the switch foot 108 to the point detection rod 114. Movement of the point detection rod 114 switches the switching mechanism(s) 116 between different positions thereof that indicate the position of the railroad switch. As will be described in more detail below, the external rod 110 is connected to a proximate end portion 120 of the point detection rod 114, which may reduce the number of points of loss (e.g., slop, play, etc.) of the operative connection of the external rod 110 between the switch foot 108 and the point detection rod 114. Moreover, the external rod 110 is routed within the switch frame 104, which may lower the profile of the switch circuit controller assembly 102 and/or reduce exposure of the external rod 110 to ballast (not shown) extending between the railroad ties (e.g., the railroad ties 400 shown herein, etc.).

Referring now to the switch frame 104, the switch frame 104 may be mounted to the stock rail 112 using any method, means, structure, mechanism, manner, arrangement, connection, connector, device, and/or the like that enables the switch circuit controller assembly 102 to function as described and/or illustrated herein (e.g., to detect the position of the railroad switch, to determine whether the railroad switch has completely set and locked in a particular position, etc.), such as, but not limited to, an adhesive, an interference fit, a snap-fit, a fastener (e.g., a threaded fastener, a non-threaded fastener, etc.), a clamp, a latch, welding, brazing, an epoxy, a clip, a ring, a cotter pin, a quick release pin, a clevis, a clevis-type connection, a bayonet-type connection, a spring override, and/or the like.

Figure 6:
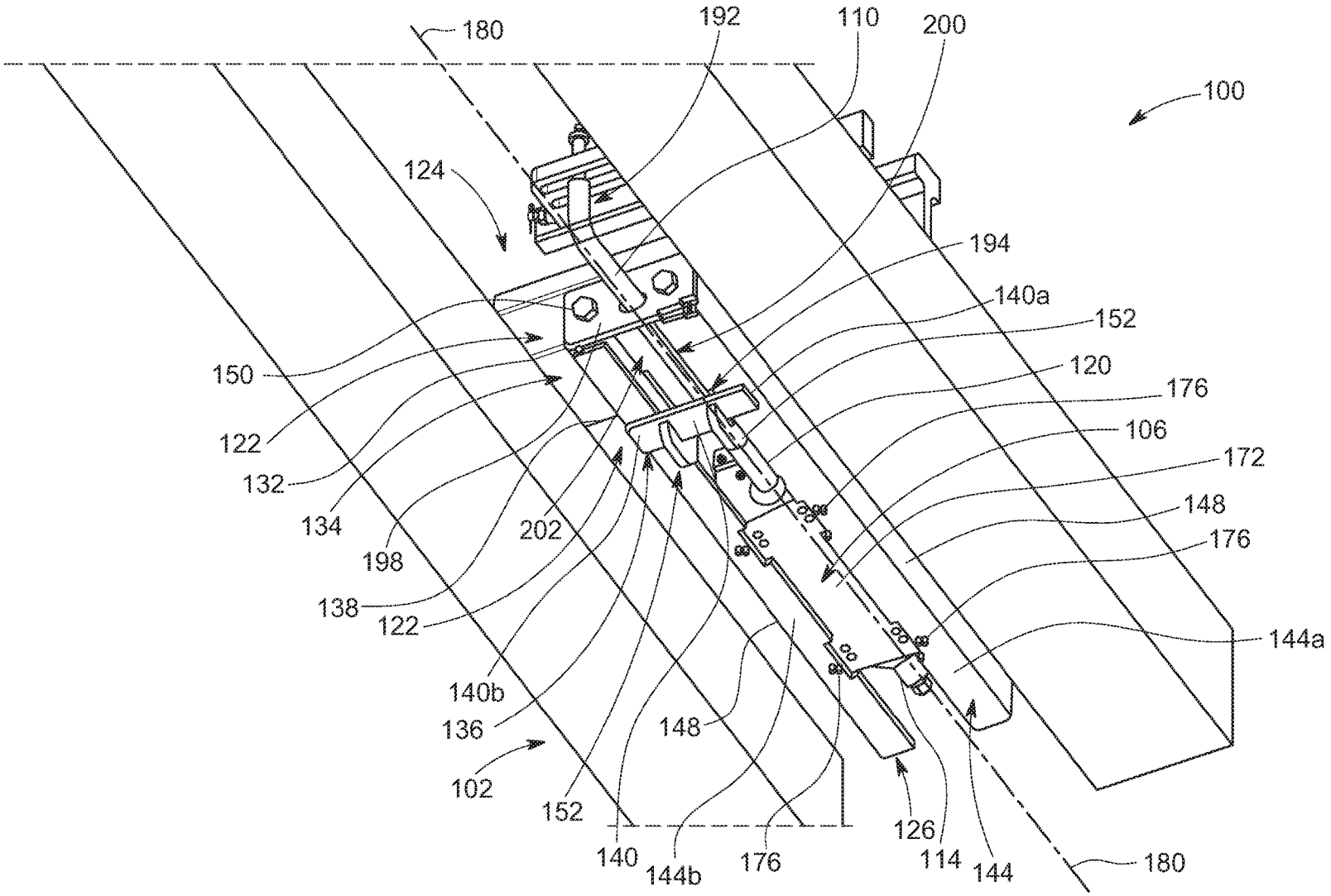
FIG. 6 is a perspective view taken from underneath the railroad switch shown in FIGS. 1-5.

In the exemplary implementation shown herein, the switch frame 104 is mounted to the stock rail 112 using a clamp 122. For example, the switch frame 104 extends a length from an end portion 124 to an end portion 126 that is opposite the end portion 124. Referring now to FIGS. 3-6, the end portion 124 of the switch frame 104 includes a clamping member 128 (not visible in FIG. 6) of the clamp 122 that includes slots 130 (not visible in FIG. 6) that are configured to receive one side 132 of a foot 134 of the stock rail 112 therein. The stock rail 112 has been removed from FIG. 4 to better illustrate the clamp 122. The switch frame 104 also includes a clamping member 136 of the clamp 122 that is configured to receive an opposite side 138 of the foot 134 of the stock rail 112 therein. For example, the clamping member 136 extends a height from a lower clamping flange 140 (not visible in FIGS. 3 and 4) to an upper clamping flange 142 (not visible in FIG. 6). The upper clamping flange 142 is configured to wrap over the side 138 of the foot 134 of the stock rail 112. The lower clamping flange 140 is configured to wrap under a lower wall 144 of the switch frame 104. Specifically, the lower clamping flange 140 includes opposite extensions 140*a* and 140*b* (best seen in FIG. 6) that are each configured to extend under a respective segment 144*a* and 144*b* of the lower wall 144, as is shown in FIG. 6.

In operation, the switch frame 104 is positioned on the stock rail 112 such that the side 132 of the foot 134 of the stock rail 112 is received into the slots 130 of the clamping member 128 with the foot 134 of the stock rail 112 resting on side rails 148 of the switch frame 104. The clamping member 136 is positioned over the side 138 of the foot 134 of the stock rail 112 such that the upper and lower clamping flanges 142 and 140, respectively, are wrapped over the side 138 of the stock rail foot 134 and the lower wall 144 of the switch frame 104, respectively. The clamping members 128 and 136 are then clamped together to generate a clamping force that holds the switch frame 104 to the foot 134 of the stock rail 112. In the exemplary implementation shown herein, the clamping members 128 and 136 are clamped together using threaded fasteners 150. Although two are shown, any number of the threaded fasteners 150 may be used to clamp the clamping members 128 and 136 together. In addition or alternatively to the threaded fasteners 150, any other type of fastener may be used to clamp the clamping members together.

The clamp 122 of the switch frame 104 optionally includes one or more wedge retainers 152 that fit over the clamping member 136 with an interference fit. For example, and referring now solely to FIG. 5, each wedge retainer 152 extends a height from a lower flange 154 to an upper flange 156. The upper flange 156 is configured to wrap over the upper clamping flange 142 of the clamping member 136. The lower flange 154 is configured to wrap over the lower clamping flange 140 of the clamping member 136. In operation, each wedge retainer 152 is positioned over the clamping member 136 such that the lower and upper flanges 154 and 156, respectively, are engaged with the lower and upper clamping flanges 140 and 142, respectively, with an interference fit. In other words, each wedge retainer 152 is fit over the clamping member 136 such that the clamping member 136 is received into an opening 158 defined between the lower clamping flange 140 and the upper clamping flange 142 of the wedge retainer 152 with an interference fit. The interference fit of each wedge retainer 152 over the clamping member 136 facilitates holding the clamping member 136 on the side 138 of the stock rail foot 134 in the event of failure of one or more of the fasteners 150. For example, upon failure of one or more of the fasteners 150, the wedge retainers 152 facilitate maintaining the clamping force between the clamping members 128 and 136 and thereby facilitate holding the switch frame 104 on the stock rail 112. Although two wedge retainers 152 are shown herein, the switch frame 104 may include any number of the wedge retainers 152. The clamp 122 described and/or illustrated herein may reduce or eliminate welding of dissimilar material thicknesses that can be prone to premature fracture.

Referring now to FIGS. 2 and 3, the switch foot 108 may be mounted to the switch rail 118 using any method, means, structure, mechanism, manner, arrangement, connection, connector, device, and/or the like that enables the switch circuit controller assembly 102 to function as described and/or illustrated herein (e.g., to detect the position of the railroad switch, to determine whether the railroad switch has completely set and locked in a particular position, etc.), such as, but not limited to, an adhesive, an interference fit, a snap-fit, a fastener (e.g., a non-threaded fastener, a threaded fastener, etc.), a clamp, a latch, welding, brazing, an epoxy, a clip, a ring, a cotter pin, a quick release pin, a clevis, a clevis-type connection, a bayonet-type connection, a spring override, and/or the like. The switch rail 118 has been removed from FIG. 2 for clarity.

In the exemplary implementation shown herein, the switch foot 108 is mounted to the switch rail 118 using one or more threaded fasteners 160 (not shown in FIG. 2). For example, the switch foot 108 includes one or more openings 162, each of which is configured to receive one or more of the fasteners 160 therein. The switch rail 118 also includes one or more openings 164, which in the exemplary implementation extend into a web 166 of the switch rail 118. Each of the openings 164 is also configured to receive one or more of the fasteners 160 therein. In operation, the fasteners 160 extend into the openings 162 and 164 to hold (e.g., threadably clamp, etc.) the switch foot 108 on the switch rail 118. In the exemplary implementation, the threaded fasteners 160 include nuts 168. In addition or alternatively to the nuts 168, in some other implementations one or more of the openings 162 and/or one or more of the openings 164 is threaded.

As is shown in FIG. 2, one or more of the openings 162 and/or one or more of the openings 164 is optionally elongated, for example to enable adjustment of the position of the switch foot 108 relative to the switch rail 118. Although the switch foot 108 is mounted to the web 166 of the switch rail 118 in the exemplary implementation, in addition or alternatively the switch foot 108 may be mounted to a foot 170 of the switch rail 118. Although only one is shown and two are implied from the number of openings 162, any number of the threaded fasteners 160 may be provided. Moreover, the switch foot 108 may include any number of the openings 162, each of which may receive any number of the threaded fasteners 160. Although only one is shown and two are implied from the number of the openings 162, the switch rail 118 may include any number of the openings 164, each of which may receive any number of the threaded fasteners 160.

Referring now to FIGS. 1 and 2, the switch controller 106 includes a housing 172 that is held by the switch frame 104. The housing 172 includes a cover 174, which has been removed from FIG. 2 for clarity. The switch controller 106 may be held by the switch frame 104 using any method, means, structure, mechanism, manner, arrangement, connection, connector, device, and/or the like that enables the switch controller 106 to function as described and/or illustrated herein (e.g., to detect the position of the railroad switch, to determine whether the railroad switch has completely set and locked in a particular position, etc.), such as, but not limited to, an adhesive, an interference fit, a snap-fit, a fastener (e.g., a non-threaded fastener, a threaded fastener, etc.), a clamp, a latch, welding, brazing, an epoxy, a clip, a ring, a cotter pin, a quick release pin, a clevis, a clevis-type connection, a bayonet-type connection, a spring override, and/or the like.

In the exemplary implementation shown herein, the housing 172 of the switch controller 106 is secured to the segments 144*a* and 144*b* of the lower wall 144 of the switch frame 104, for example using the threaded fasteners 176 shown in FIG. 6. Although four are shown, any number of threaded fasteners 176 may be provided. Moreover, in some other implementations, the housing 172 of the switch controller 106 is additionally or alternatively secured to one or more other components of the switch frame 104 (e.g., one or both of the side rails 148, etc.).

Figure 7:
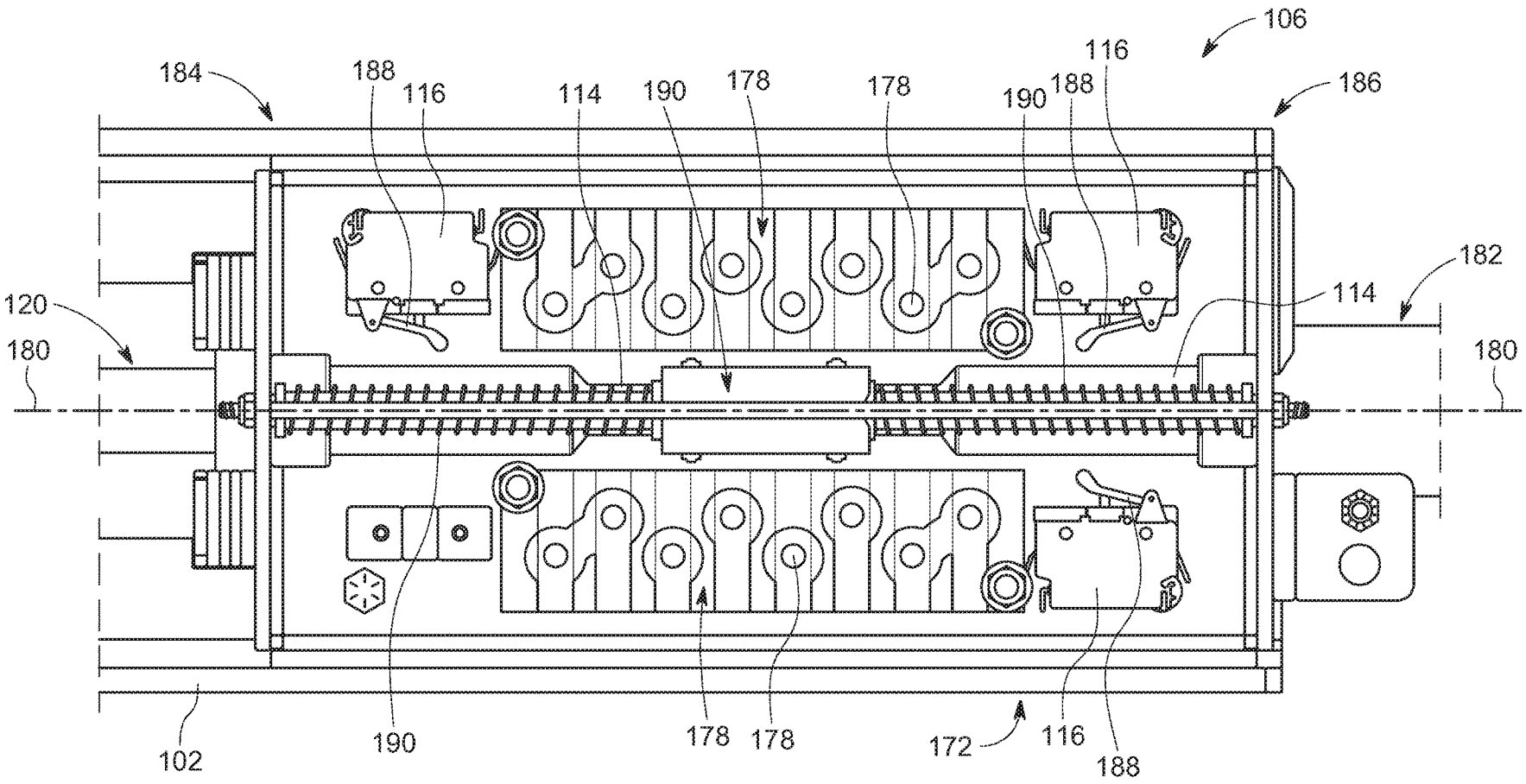
FIG. 7 is a top plan view illustrating a switch controller of the switch circuit controller assembly according to an implementation.
Figure 8:
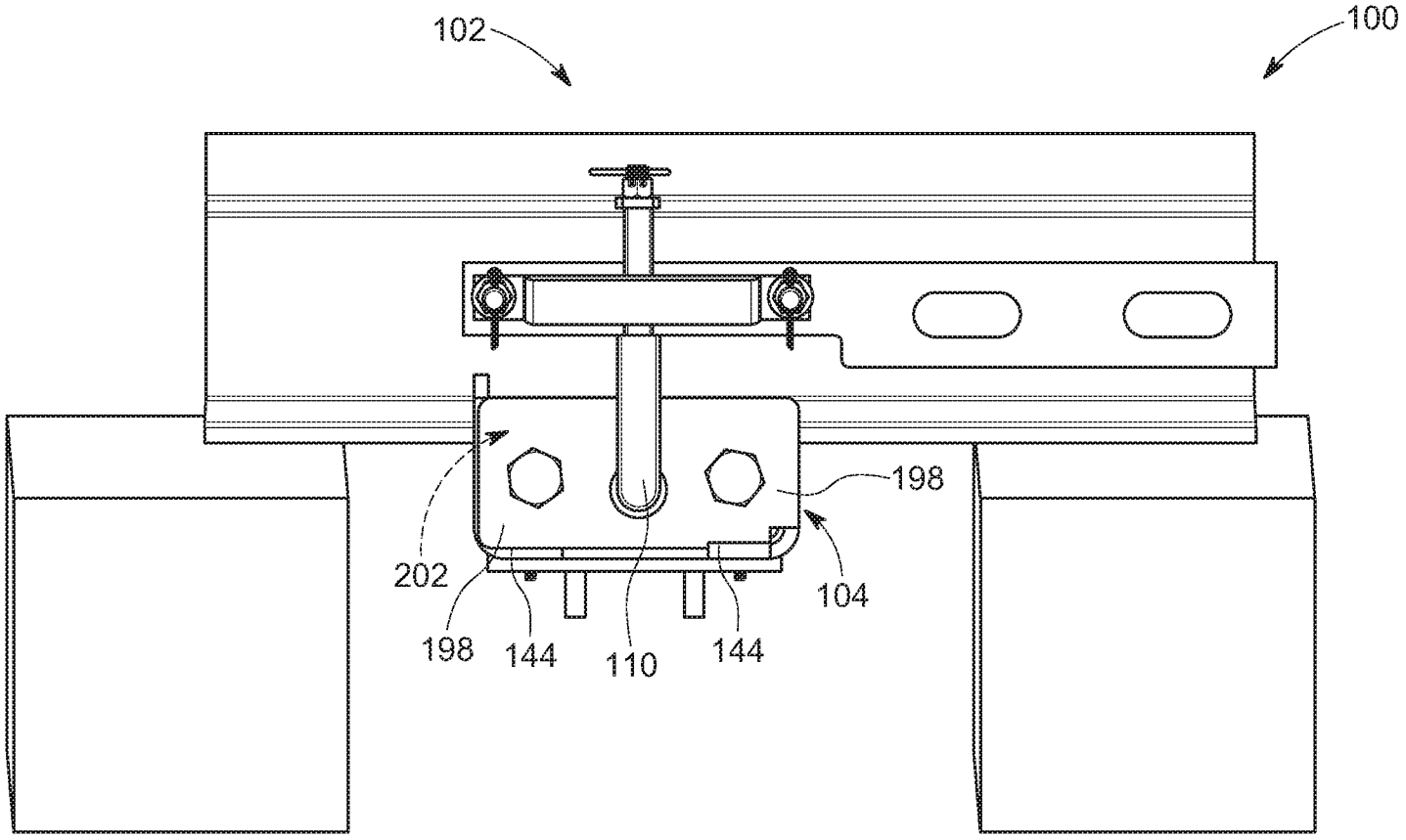
FIG. 8 is an end elevational view of the railroad switch shown in FIGS. 1-7.

Referring now to FIGS. 3 and 7, the switch controller 106 includes one or more of the switching mechanisms 116. Each switching mechanism 116 includes two or more positions that indicate whether the railroad switch is in a particular position. Although four are shown in FIG. 3 and three are shown in FIG. 7, the switch controller 106 may include any number of the switching mechanisms 116. Moreover, each switching mechanism 116 may be any type of switching mechanism that enables the switch controller 106 to function as described and/or illustrated herein (e.g., to detect the position of the railroad switch, to determine whether the railroad switch has completely set and locked in a particular position, etc.), such as, but not limited to, a switch, a relay, a cam-activated switching mechanism, and/or the like. The switch controller 106 also includes electrical terminals 178 for electrical connection of the switching mechanisms 116 to various other components of the railroad switch (e.g., a control system, a monitoring station, etc.). The switch controller 106 may include any number of the electrical terminals 178. Each electrical terminal 178 may be any type of electrical terminal, such as, but not limited to, the electrical terminals 178 illustrated in FIGS. 2-4 and 9, the electrical terminals 178 shown in FIG. 7, and/or the like.

The switch controller 106 includes the point detection rod 114, which extends a length along a central longitudinal axis 180 of the switch circuit controller assembly 102 from the proximate end portion 120 to a distal end portion 182. The length of the point detection rod 114 optionally extends through the length of the housing 172 such that the proximate end portion 120 and/or the distal end portion 182 optionally extend outwardly from opposite ends 184 and 186 of the housing 172, for example as shown in the exemplary implementation. As shown in FIG. 3, the proximate end portion 120 of the point detection rod 114 is located closer to the stock rail 118 as compared to the distal end portion 182. Optionally, the distal end portion 182 of the point detection rod is a free end portion, for example as shown in FIG. 3.

The point detection rod 114 is configured to reciprocate along the central longitudinal axis 180 within the housing 172 between two or more different positions of the point detection rod 114 that correspond to the different positions of the switching mechanisms 116. The point detection rod 114 is operatively connected to the switching mechanisms 116 such that the reciprocating movement of the point detection rod 114 is configured to switch the switching mechanisms 116 between the positions thereof (e.g., activate a switching mechanism 116, de-activate a switching mechanism 116, etc.). The point detection rod 114 may be operatively connected to the switching mechanisms 116 using any method, means, structure, mechanism, manner, arrangement, connection, connector, device, and/or the like that enables the point detection rod 114 to function as described and/or illustrated herein (e.g., to move the switching mechanisms between the positions thereof, etc.). For example, in the exemplary implementation of the switch controller 106, the switching mechanisms 116 include switching arms 188 that are configured to be engaged and disengaged by corresponding segments of the point detection rod 114 to move the switching mechanism 116 between the positions thereof. Other method, means, structures, mechanisms, manners, arrangements, connections, connectors, devices, and/or the like are contemplated to be within the scope of the present disclosure (e.g., cams, etc.). Optionally, the switch controller 106 includes a biasing device 190 that is operatively connected to the point detection rod 114 such that the biasing device 190 is configured to bias the point detection rod 114 to a predetermined position along the central longitudinal axis 180 relative to the switching mechanisms 116 (e.g., a neutral position, a center position along the length of the housing 172 for example as is shown in FIG. 7, a position that corresponds to one of the positions of the railroad switch, etc.).

Figure 4:
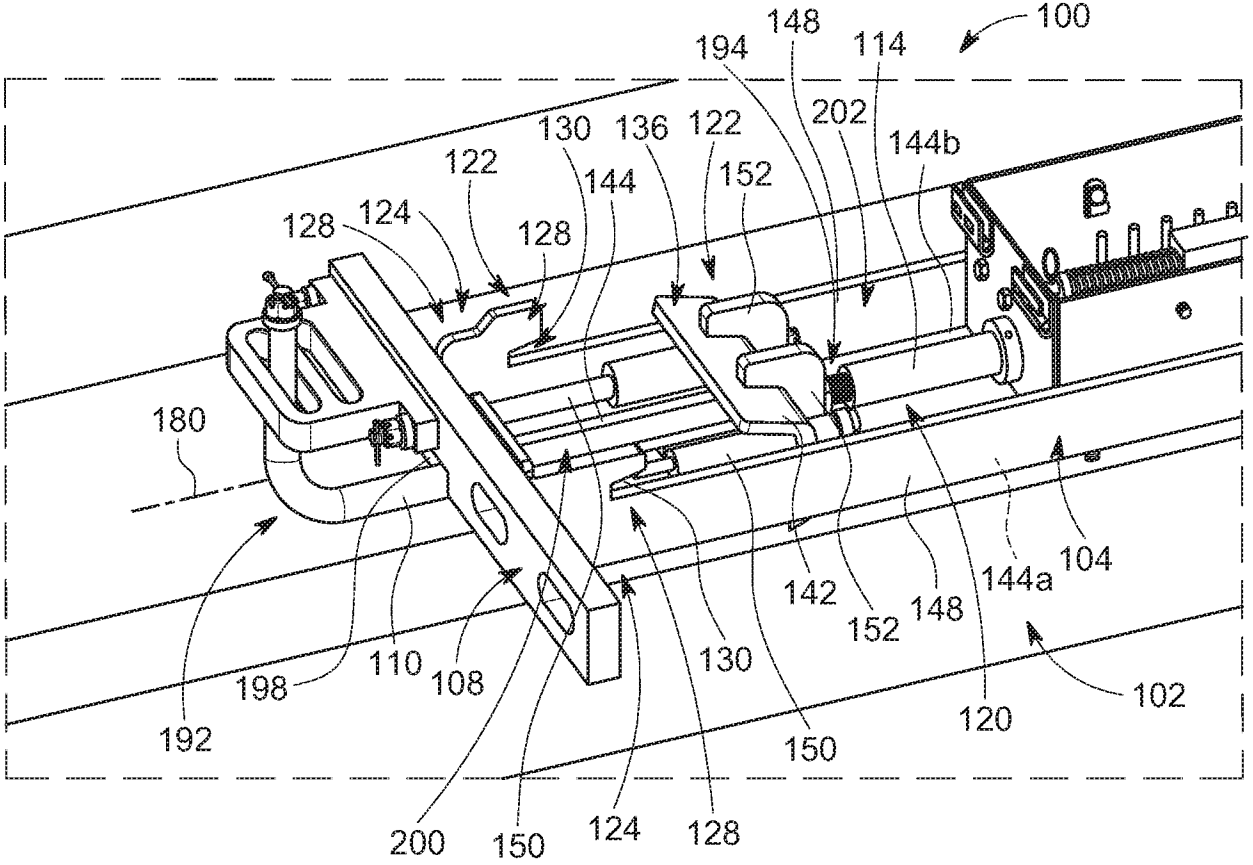
FIG. 4 is a perspective view illustrating a clamp of the switch circuit controller assembly shown in FIG. 2 according to an implementation.
Figure 5:
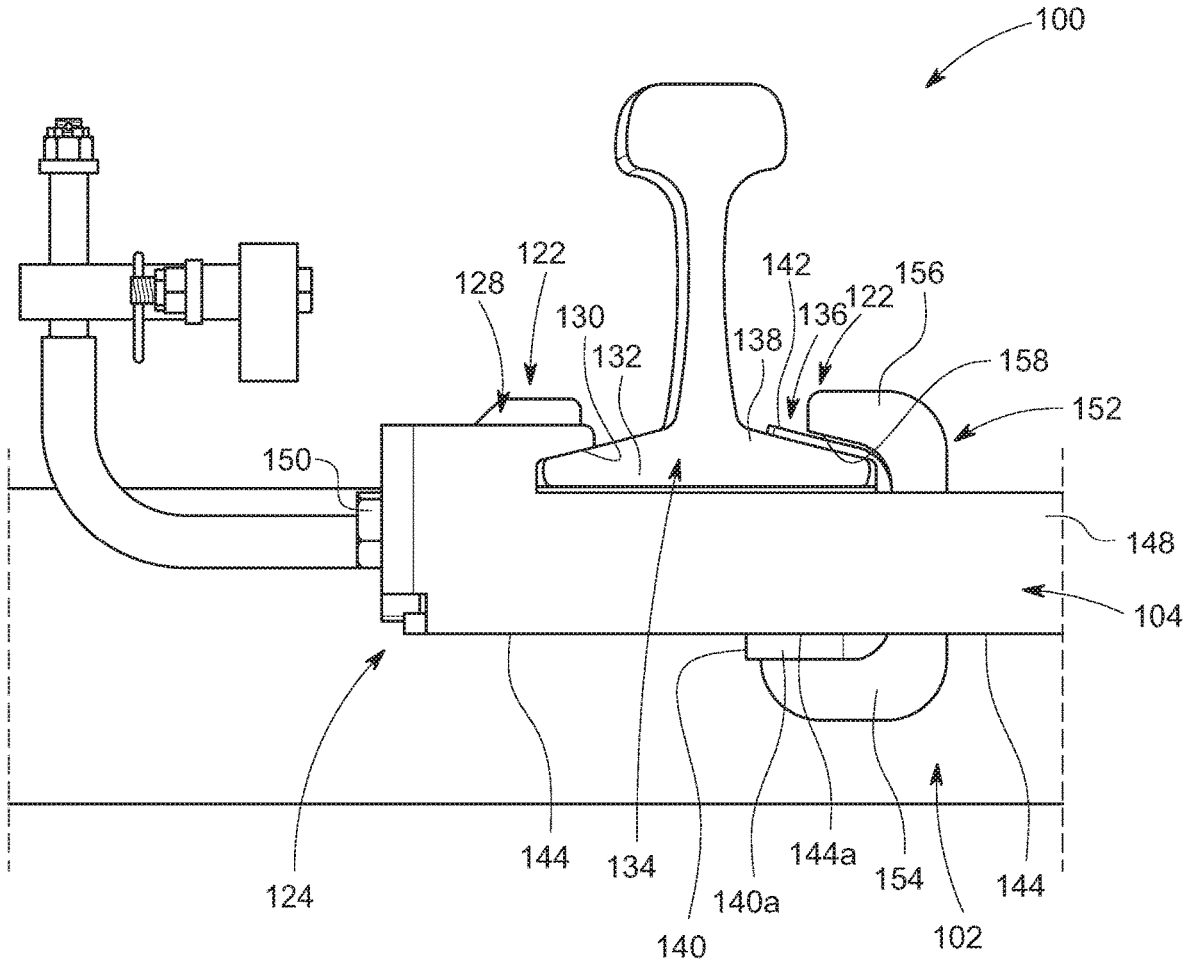
FIG. 5 is an elevational view illustrating the clamp shown in FIG. 4.

Referring now to FIGS. 3, 4, and 6, the external rod 110 is connected to the proximate end portion 120 of the point detection rod 114, as briefly described above. For example, the exemplary implementation of the external rod 110 extends a length from an end portion 192 to an opposite end portion 194. The end portion 192 of the external rod 110 is operatively connected to the switch foot 108, for example as will be described below.

The end portion 194 of the external rod 110 is connected to the proximate end portion 120 of the point detection rod 114 such that movement of the external rod 110 along the central longitudinal axis 180 is translated to the point detection rod 114. As should be apparent from FIGS. 1-10, the length of the external rod 110 is aligned vertically (e.g., is in line vertically, aligned within the same horizontal plane, etc.) with the length of the point detection rod 114. The end portion 194 of the external rod 110 may be connected to the proximate end portion 120 of the point detection rod 114 using any method, means, structure, mechanism, manner, arrangement, connection, connector, device, and/or the like that enables the external rod 110 to function as described and/or illustrated herein (e.g., to translate movement of the switch foot 108 to the point detection rod 114, etc.), such as, but not limited to, an adhesive, an interference fit, a snap-fit, a fastener (e.g., a threaded fastener, a non-threaded fastener, etc.), a clamp, a latch, welding, brazing, an epoxy, a clip, a ring, a cotter pin, a quick release pin, a clevis, a clevis-type connection, a bayonet-type connection, a spring override, and/or the like. In the exemplary implementation shown herein, the end portion 194 of the external rod 110 is connected to the proximate end portion 120 of the point detection rod 114 with a threaded connection 196.

The connection of the external rod 110 to the proximate end portion 120 of the point detection rod 114 (and/or the vertical alignment of the length of the external rod 110 with the length of the point detection rod 114) provides a more direct connection between the external rod 110 and the point detection rod 114, for example as compared to known arrangements wherein an external rod is connected to the distal end of a point detection rod, etc. For example, connection of the external rod 110 to the proximate end portion 120 of the point detection rod 114 reduces the number of linkages, connection points, and/or the like (e.g., linking rods, articulating joints, etc.) between the switch foot 108 and the point detection rod 114 that can require adjustment, can increase the loss of motion over time, and/or the like. Accordingly, the exemplary connection of the external rod 110 to the proximate end portion 120 of the point detection rod 144 reduces the number of points of loss (e.g., slop, play, etc.) of the operative connection of the external rod 110 between the switch foot 108 and the point detection rod 114, which may reduce the amount of adjustment required over time, reduce the loss of motion over time, and/or the like. In some examples, the operative connection of the external rod 110 between the switch foot 108 and the point detection rod 114 has less than three points of loss. In some other examples, the operative connection of the external rod 110 between the switch foot 108 and the point detection rod 114 has less than two points of loss (e.g., a single point of loss at the operative connection between the switch foot 108 and the end portion 192 of the external rod 110, etc.).

As briefly described above, and referring now to FIGS. 3, 4, 6, and 8, the external rod 110 is routed within the switch frame 104. For example, the length of the external rod 110 extends through a side wall 198 of the switch frame 104 such that a segment 200 (not visible in FIG. 8) of the length of the external rod 110 that includes the end portion 194 extends within an interior cavity 202 of the switch frame 104. For example, the external rod 110 extends above the lower wall 144 of the switch frame 104 when the switch frame 104 is mounted to the stock rail 112. As the segment 200 of the external rod 110 extends within the interior cavity 202 of the switch frame 104, the connection between the end portion 194 of the external rod 110 and the proximate end portion 120 (not visible in FIG. 8) of the point detection rod 114 (not visible in FIG. 8) also extends within the interior cavity 202 of the switch frame 104.

Routing the external rod 110 within the switch frame 104 lowers the profile of the switch circuit controller assembly 102, for example as compared to known arrangements wherein an external rod is routed underneath the switch frame 104, etc. For example, routing the length of the external rod 110 within the interior cavity 202 of the switch frame 104 such that the external rod 110 extends above the lower wall 144 of the switch frame 104 lowers the profile of the switch circuit controller assembly 102. For example, routing the length of the external rod 110 within the interior cavity 202 of the switch frame 104 may reduce the profile of the switch circuit controller assembly 102 by approximately a quarter of an inch, approximately a half of an inch, approximately an inch, between approximately an eighth of an inch and approximately an inch and a half, and/or the like. By lowering the profile of the switch circuit controller assembly 102, the implementations described and/or illustrated herein may reduce or eliminate the impact of dragging equipment interfering with and/or damaging the switch controller 106. Routing the external rod 110 within the switch frame 104 may reduce exposure of the external rod 110 to ballast that extends between railroad ties (e.g., as compared to known arrangements wherein an external rod is routed underneath the switch frame 104, etc.), which may reduce or eliminate the impact of ballast interfering with and/or damaging the external rod 110.

Figure 9:
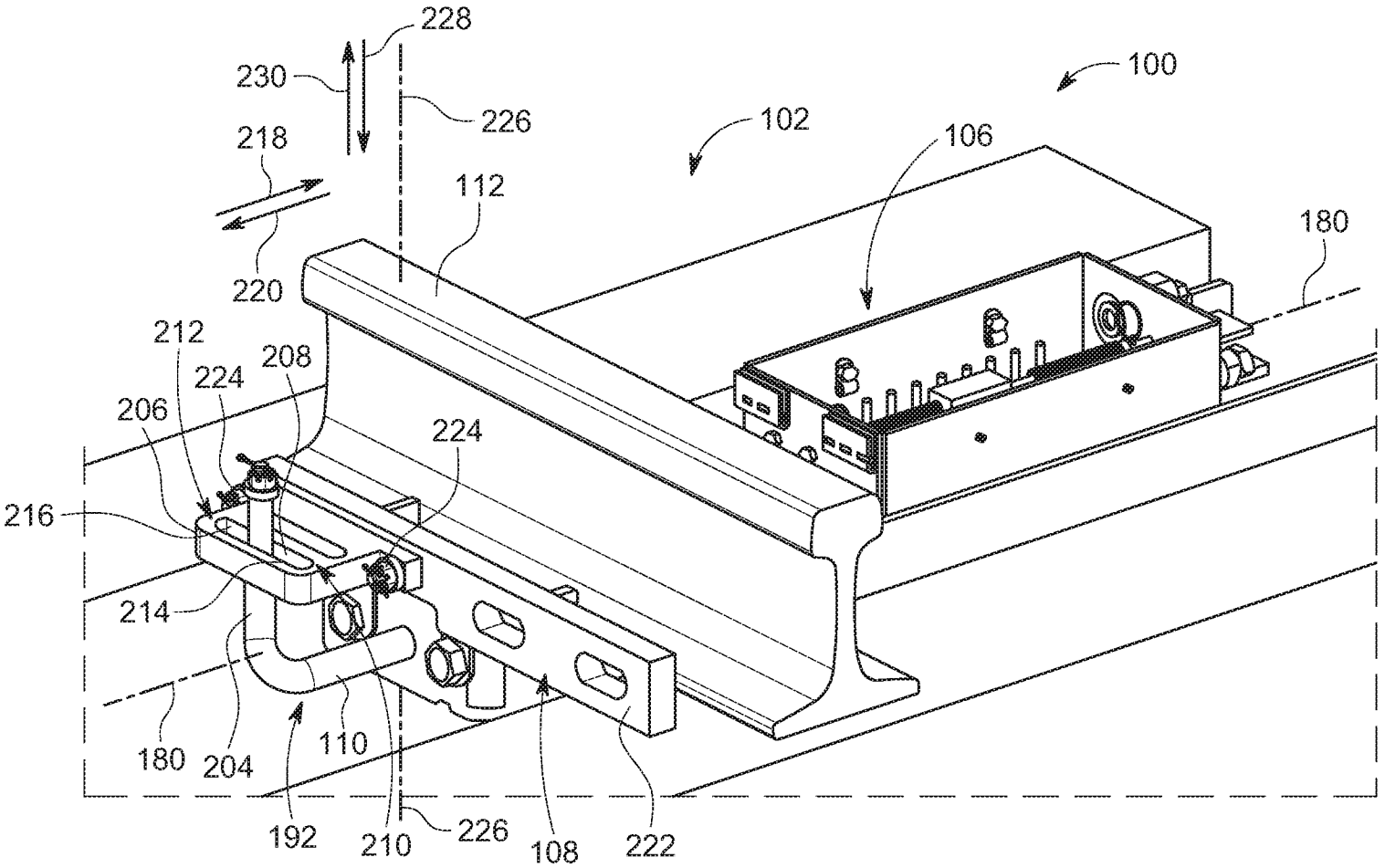
FIG. 9 is a perspective view of the railroad switch shown in FIGS. 1-8 illustrating a switch foot of the switch circuit controller assembly according to an implementation.
Figure 10:
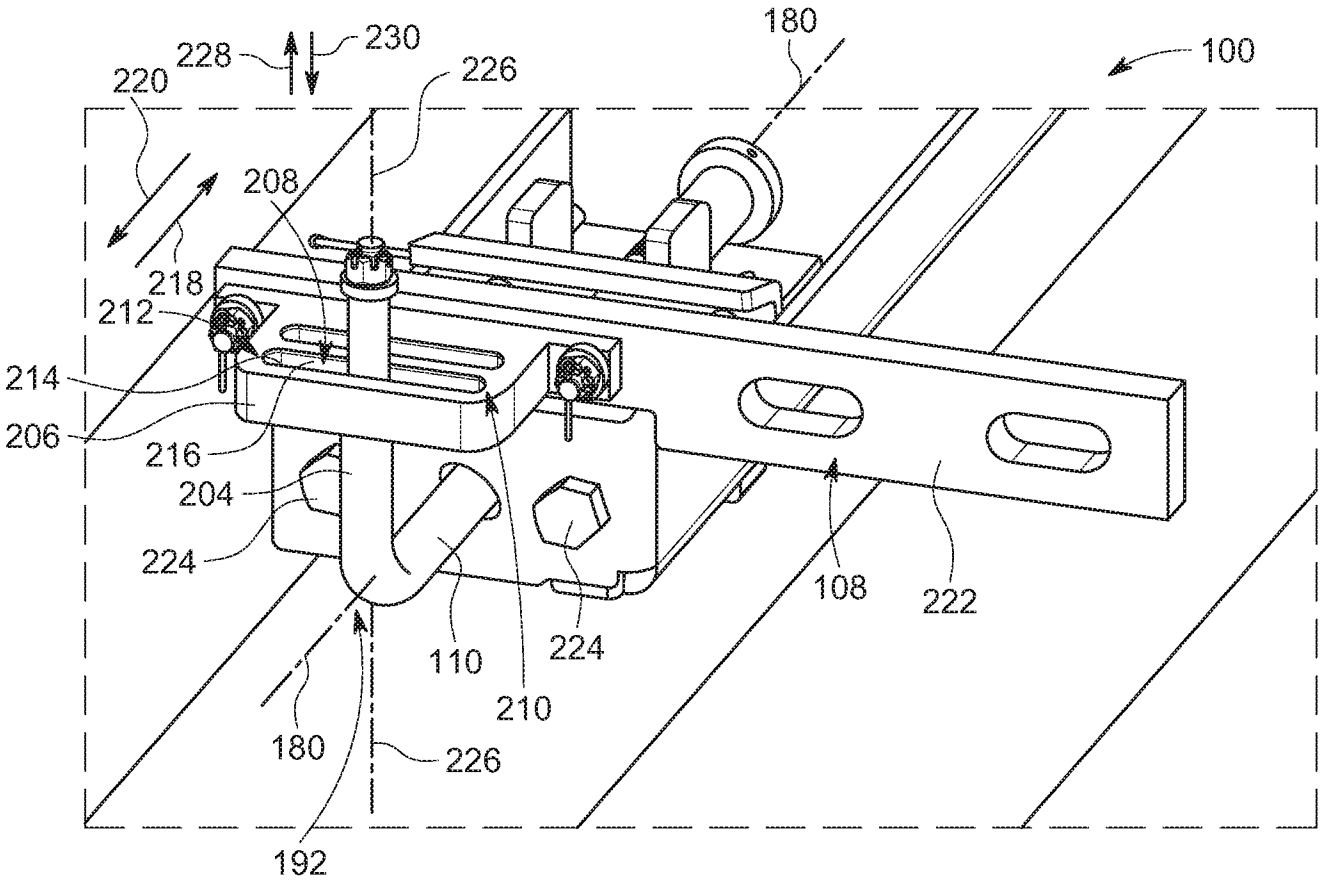
FIG. 10 is a perspective view of a portion of the switch circuit assembly illustrating the switch foot.

Referring now to FIGS. 3, 9, and 10, the exemplary implementation of the external rod 110 shown herein is operatively connected to the switch foot 108 such that the external rod 110 is configured to translate movement of the switch foot 108 to the point detection rod 114 (not visible in FIG. 9 or 10). For example, the end portion 192 of the external rod 110 includes a leg 204 that extends vertically outward from the length of the external rod 110. The exemplary implementation of the switch foot 108 includes a flange 206 that includes one or more openings 208 extending therein. The opening 208 extends a length from an end portion 210 to an opposite end portion 212 and includes opposing sidewalls 214 and 216 that extend along the length thereof. As shown in FIGS. 3, 9, and 10, the leg 204 of the external rod 110 is received into the opening 208 of the switch foot flange 206 such that when the switch foot 108 moves in the direction of the arrow 218, the sidewall 214 pushes against the leg 204 of the external rod 110 to thereby move the external rod 110 along the central longitudinal axis 180 in the direction 218. Similarly, when the switch foot 108 moves in the direction of the arrow 220, the sidewall 216 of the switch foot opening 208 pushes against the leg 204 of the external rod 110 to thereby move the external rod 110 along the central longitudinal axis 180 in the direction 220. Although two are shown, the flange 206 of the switch foot 108 may include any number of the openings 208 (e.g., multiple openings 208 may be provided to enable adjustment of the position of the external rod 110 relative to the switch foot 108, the point detection rod 114, etc.).

In the exemplary implementation shown herein, the flange 206 is mounted to a body 222 of the switch foot 108 using any number of threaded fasteners 224. In addition or alternatively to the threaded fasteners 224, the flange 206 may be mounted to the body 222 using any method, means, structure, mechanism, manner, arrangement, connection, connector, device, and/or the like that enables the switch foot 108 to function as described and/or illustrated herein (e.g., to translate movement of the switch foot 108 to the external rod 110, etc.), such as, but not limited to, an adhesive, an interference fit, a snap-fit, a non-threaded fastener, a clamp, a latch, welding, brazing, an epoxy, a clip, a ring, a cotter pin, a quick release pin, a clevis, a clevis-type connection, a bayonet-type connection, a spring override, and/or the like. In some other implementations, the flange 206 is integrally formed with the body 222 as a single, unitary structure.

In some implementations, the operative connection between the external rod 110 and the switch foot 108 is configured to accommodate at least some rail run (e.g., longitudinal thermodynamic growth, etc.) of the stock rail 112 and/or the switch rail 118 (not shown in FIG. 9 or 10). For example, the opening 208 is optionally an elongate slot. The length of the slot 208 from the end portion 210 to the end portion 212 extends along the length of the stock rail 112 when the switch frame 104 is mounted to the stock rail 112. The leg 204 of the external rod 110 is free to move (e.g., float, etc.) along the length of the slot 208, for example to accommodate rail run of the rails 112 and/or 118, etc. By enabling the leg 204 of the external rod 110 to move along the length of the slot 208, the operative connection between the external rod 110 and the switch foot 108 may reduce or eliminate damage to one or more components of the switch circuit controller assembly 102 (e.g., the switch controller 106, the external rod 110, the switch foot 108, etc.).

In some implementations, the operative connection between the external rod 110 and the switch foot 108 is configured to accommodate at least some vertical movement of the stock rail 112 and/or the switch rail 118. For example, in the exemplary implementation shown herein, the opening 208 extends completely through the flange 206 of the switch foot 108 and the leg 204 of the external rod 110 extends completely through the opening 208. The leg 204 of the external rod 110 is therefore free to move (e.g., float, etc.) along a vertical axis 226 relative to the switch foot 108 to accommodate vertical movement of the stock rail 112 and/or the switch rail 118, for example rail hump caused by vertical pumping motion of the rails 112 and/or 118 as a rail car moves over the rails 112 and/or 118, etc. For example, the leg 204 of the external rod 110 is configured to move along the vertical axis 226 (not shown in FIG. 3) in the direction of the arrow 228 as the stock rail 112 and/or the switch rail 118 moves vertically along the vertical axis 226 in the direction 228; and the leg 204 of the external rod 110 is configured to move along the vertical axis 226 in the direction of the arrow 230 as the stock rail 112 and/or the switch rail 118 moves vertically along the vertical axis 226 in the direction 230. By enabling the leg 204 of the external rod 110 to move vertically relative to the switch foot 108, the operative connection between the external rod 110 and the switch foot 108 may reduce or eliminate damage to one or more components of the switch circuit controller assembly 102 (e.g., the switch controller 106, the external rod 110, the switch foot 108, etc.).

Although the opening 208 of the switch foot 108 extends completely through the flange 206 of the switch foot 108 in the exemplary implementation shown herein, in some other implementations the opening 208 does not extend completely through the flange 206 and has a depth with a dimension that enables at least some vertical movement of the leg 204 of the external rod 110 relative to the switch foot 108, for example to accommodate vertical movement of the rails 112 and/or 118, etc.

Various implementations of the present disclosure reduce the number of points of loss (e.g., slop, play, etc.) between a switch foot and a point detection rod, which may reduce the amount of adjustment required over time, reduce the loss of motion over time, and/or the like. For example, various implementations of the present disclosure reduce linkages, connection points, and/or the like (e.g., linking rods, articulating joints, etc.) between the switch foot and the point detection rod that can require adjustment, can increase the loss of motion over time, and/or the like. Various implementations of the present disclosure lower the profile of a switch circuit controller assembly, which may reduce or eliminate the impact of dragging equipment interfering with and/or damaging the switch controller. Various implementations of the present disclosure may reduce exposure of the external rod to ballast between the railroad ties, which may reduce or eliminate the impact of ballast interfering with and/or damaging the external rod. Various implementations of the present disclosure accommodate at least some vertical movement of railroad rails (e.g., vertical pumping motion sometimes referred to as "rail hump", etc.), which may reduce or eliminate damage to the switch controller, an external rod, a switch foot, and/or other components of the switch circuit controller assembly caused by such vertical movement. Various implementations of the present disclosure accommodate at least some rail run (e.g., thermodynamic growth of the length of a railroad rail, etc.), which may reduce or eliminate damage to the switch controller, an external rod, a switch foot, and/or other components of the switch circuit controller assembly caused by rail run.

The following clauses describe further aspects:

Clause Set A:

A1. A railroad switch circuit controller assembly comprising:

a switch frame configured to be mounted to a stock rail;

a switch controller held by the switch frame, the switch controller comprising at least one switching mechanism, the switch controller comprising a point detection rod operatively connected to the at least one switching mechanism, the point detection rod extending a length from a proximate end portion to a distal end portion, wherein the proximate end portion of the point detection rod is located closer to the stock rail as compared to the distal end portion when the switch frame is mounted to the stock rail;

a switch foot configured to be mounted to a switch rail; and an external rod operatively connected between the switch foot and the point detection rod of the switch controller such that the external rod is configured to translate linear movement of the switch foot toward and away from the stock rail to the point detection rod, wherein the external rod is connected to the proximate end portion of the point detection rod.

A2. The railroad switch circuit controller assembly of clause A1, wherein the distal end portion of the point detection rod is a free end portion.

A3. The railroad switch circuit controller assembly of clause A1, wherein the external rod extends within the switch frame.

A4. The railroad switch circuit controller assembly of clause A1, wherein the external rod is configured to extend above a lower wall of the switch frame when the switch frame is mounted to the stock rail.

A5. The railroad switch circuit controller assembly of clause A1, wherein the switch foot comprises a slot having a length that is configured to extend along a length of the stock rail when the switch frame is mounted to the stock rail, the external rod being operatively connected to the switch foot such that the external rod extends within the slot, wherein the external rod is free to move within the slot along the length of the slot.

A6. The railroad switch circuit controller assembly of clause A1, wherein the switch foot comprises an opening, the external rod being operatively connected to the switch foot such that the external rod extends within the opening, wherein the external rod free to move vertically within the opening relative to the switch foot.

A7. The railroad switch circuit controller assembly of clause A1, wherein the operative connection of the external rod between the switch foot and the point detection rod has less than three points of loss.

A8. The railroad switch circuit controller assembly of clause A1, wherein the operative connection of the external rod between the switch foot and the point detection rod has less than two points of loss.

A9. The railroad switch circuit controller assembly of clause A1, wherein the switch frame is configured to be mounted to the stock rail using a clamp, the switch frame further comprising a wedge retainer that is fit over a clamping member of the clamp with an interference fit.

A10. The railroad switch circuit controller assembly of clause A1, wherein the at least one switching mechanism comprises at least one of a switch or a relay.

Clause Set B:

B1. A railroad switch assembly comprising:

a switch rail; and a switch circuit controller assembly comprising:

a switch frame configured to be mounted to a stock rail of a railroad;

a switch controller held by the switch frame, the switch controller comprising at least one switching mechanism, the switch controller comprising a point detection rod operatively connected to the at least one switching mechanism, the point detection rod extending a length from a proximate end portion to a distal end portion, wherein the proximate end portion of the point detection rod is located closer to the stock rail as compared to the distal end portion when the switch frame is mounted to the stock rail;

a switch foot mounted to a switch rail; and an external rod operatively connected between the switch foot and the point detection rod of the switch controller such that the external rod is configured to translate linear movement of the switch foot toward and away from the stock rail to the point detection rod, wherein the external rod is connected to the proximate end portion of the point detection rod.

B2. The railroad switch assembly of clause B1, wherein the distal end portion of the point detection rod is a free end portion.

B3. The railroad switch assembly of clause B1, wherein the external rod extends above a lower wall of the switch frame.

B4. The railroad switch assembly of clause B1, wherein the external rod is operatively connected to the switch foot such that the external rod extends within an opening of the switch foot, the external rod being free to move within the opening along the length of the stock rail relative to the switch foot, the external rod being free to move within the opening vertically relative to the stock rail.

B5. The railroad switch assembly of clause B1, wherein the operative connection of the external rod between the switch foot and the point detection rod has less than two points of loss.

Clause Set C:

C1. A railroad switch circuit controller assembly comprising:

a switch frame configured to be mounted to a stock rail;

a switch controller held by the switch frame, the switch controller comprising at least one switching mechanism, the switch controller comprising a point detection rod operatively connected to the at least one switching mechanism;

a switch foot configured to be mounted to a switch rail; and an external rod operatively connected between the switch foot and the point detection rod of the switch controller such that the external rod is configured to translate linear movement of the switch foot toward and away from the stock rail to the point detection rod, wherein the external rod extends within an interior cavity of the switch frame.

C2. The railroad switch circuit controller assembly of clause C1, wherein the external rod is configured to extend above a lower wall of the switch frame when the switch frame is mounted to the stock rail.

C3. The railroad switch circuit controller assembly of clause C1, wherein the switch foot comprises a slot having a length that is configured to extend along a length of the stock rail when the switch frame is mounted to the stock rail, the external rod being operatively connected to the switch foot such that the external rod extends within the slot, wherein the external rod is free to move within the slot along the length of the slot.

C4. The railroad switch circuit controller assembly of clause C1, wherein the switch foot comprises an opening, the external rod being operatively connected to the switch foot such that the external rod extends within the opening, wherein the external rod free to move vertically within the opening relative to the switch foot.

C5. The railroad switch circuit controller assembly of clause C1, wherein the operative connection of the external rod between the switch foot and the point detection rod has less than two points of loss.

As used herein, a structure, limitation, or element that is "configured to" perform a task or operation is particularly structurally formed, constructed, or adapted in a manner corresponding to the task or operation. For purposes of clarity and the avoidance of doubt, an object that is merely capable of being modified to perform the task or operation is not "configured to" perform the task or operation as used herein.

Any range or value given herein can be extended or altered without losing the effect sought, as will be apparent to the skilled person.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims.

It will be understood that the benefits and advantages described above can relate to one embodiment or can relate to several embodiments. The embodiments are not limited to those that solve any or all of the stated problems or those that have any or all of the stated benefits and advantages. It will further be understood that reference to 'an' item refers to one or more of those items.

The term "comprising" is used in this specification to mean including the feature(s) or act(s) followed thereafter, without excluding the presence of one or more additional features or acts.

The order of execution or performance of the operations in examples of the disclosure illustrated and described herein is not essential, unless otherwise specified. That is, the operations can be performed in any order, unless otherwise specified, and examples of the disclosure can include additional or fewer operations than those disclosed herein. For example, it is contemplated that executing or performing a particular operation before, contemporaneously with, or after another operation (e.g., different steps, etc.) is within the scope of aspects of the disclosure.

When introducing elements of aspects of the disclosure or the examples thereof, the articles "a," "an," "the," and "said" are intended to mean that there are one or more of the elements. The terms "comprising," "including," and "having" are intended to be inclusive and mean that there can be additional elements other than the listed elements. The term "exemplary" is intended to mean "an example of" The phrase "one or more of the following: A, B, and C" means "at least one of A and/or at least one of B and/or at least one of C."

Having described aspects of the disclosure in detail, it will be apparent that modifications and variations are possible without departing from the scope of aspects of the disclosure as defined in the appended claims. As various changes could be made in the above constructions, products, and methods without departing from the scope of aspects of the disclosure, it is intended that all matter contained in the above description and shown in the accompanying drawings shall be interpreted as illustrative and not in a limiting sense.

It is to be understood that the above description is intended to be illustrative, and not restrictive. For example, the above-described embodiments (and/or aspects thereof) can be used in combination with each other. In addition, many modifications can be made to adapt a particular situation or material to the teachings of the various embodiments of the disclosure without departing from their scope. While the dimensions and types of materials described herein are intended to define the parameters of the various embodiments of the disclosure, the embodiments are by no means limiting and are example embodiments. Many other embodiments will be apparent to those of ordinary skill in the art upon reviewing the above description. The scope of the various embodiments of the disclosure should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, the terms "first," "second," and "third," etc. are used merely as labels, and are not intended to impose numerical requirements on their objects. Further, the limitations of the following claims are not written in means-plus-function format and are not intended to be interpreted based on 35 U.S.C. § 112(f), unless and until such claim limitations expressly use the phrase "means for" followed by a statement of function void of further structure.

This written description uses examples to disclose the various embodiments of the disclosure, including the best mode, and also to enable any person of ordinary skill in the art to practice the various embodiments of the disclosure, including making and using any devices or systems and performing any incorporated methods. The patentable scope of the various embodiments of the disclosure is defined by the claims, and can include other examples that occur to those persons of ordinary skill in the art. Such other examples are intended to be within the scope of the claims if the examples have structural elements that do not differ from the literal language of the claims, or if the examples include equivalent structural elements with insubstantial differences from the literal language of the claims.

What is claimed is:

1. A railroad switch circuit controller assembly comprising:

a switch frame configured to be mounted to a stock rail;

a switch controller held by the switch frame, the switch controller comprising at least one switching mechanism, the switch controller comprising a point detection rod operatively connected to the at least one switching mechanism, the point detection rod extending a length from a proximate end portion to a distal end portion, wherein the proximate end portion of the point detection rod is located closer to the stock rail as compared to the distal end portion when the switch frame is mounted to the stock rail;

a switch foot configured to be mounted to a switch rail, wherein the switch foot comprises a slot having a length that is configured to extend along a length of the stock rail when the switch frame is mounted to the stock rail; and an external rod operatively connected between the switch foot and the point detection rod of the switch controller such that the external rod is configured to translate linear movement of the switch foot toward and away from the stock rail to the point detection rod, the external rod being operatively connected to the switch foot such that the external rod extends within the slot, wherein the external rod is connected to the proximate end portion of the point detection rod and the external rod is free to move within the slot along the length of the slot.

2. The railroad switch circuit controller assembly of claim 1, wherein the distal end portion of the point detection rod is a free end portion.

3. The railroad switch circuit controller assembly of claim 1, wherein the external rod extends within the switch frame.

4. The railroad switch circuit controller assembly of claim 1, wherein the external rod is configured to extend above a lower wall of the switch frame when the switch frame is mounted to the stock rail.

5. The railroad switch circuit controller assembly of claim 1, wherein the switch foot comprises an opening, the external rod being operatively connected to the switch foot such that the external rod extends within the opening, wherein the external rod is free to move vertically within the opening relative to the switch foot.

6. The railroad switch circuit controller assembly of claim 1, wherein the operative connection of the external rod between the switch foot and the point detection rod has less than three points of loss.

7. The railroad switch circuit controller assembly of claim 1, wherein the operative connection of the external rod between the switch foot and the point detection rod has less than two points of loss.

8. The railroad switch circuit controller assembly of claim 1, wherein the switch frame is configured to be mounted to the stock rail using a clamp, the switch frame further comprising a wedge retainer that is fit over a clamping member of the clamp with an interference fit.

9. The railroad switch circuit controller assembly of claim 1, wherein the at least one switching mechanism comprises at least one of a switch or a relay.

10. A railroad switch assembly comprising:

a switch rail; and a switch circuit controller assembly comprising:

a switch frame configured to be mounted to a stock rail of a railroad;

a switch controller held by the switch frame, the switch controller comprising at least one switching mechanism, the switch controller comprising a point detection rod operatively connected to the at least one switching mechanism, the point detection rod extending a length from a proximate end portion to a distal end portion, wherein the proximate end portion of the point detection rod is located closer to the stock rail as compared to the distal end portion when the switch frame is mounted to the stock rail;

a switch foot mounted to a switch rail, wherein the switch foot comprises a slot having a length that is configured to extend along a length of the stock rail when the switch frame is mounted to the stock rail; and an external rod operatively connected between the switch foot and the point detection rod of the switch controller such that the external rod is configured to translate linear movement of the switch foot toward and away from the stock rail to the point detection rod, the external rod being operatively connected to the switch foot such that the external rod extends within the slot, wherein the external rod is connected to the proximate end portion of the point detection rod and the external rod is free to move within the slot along the length of the slot.

11. The railroad switch assembly of claim 10, wherein the distal end portion of the point detection rod is a free end portion.

12. The railroad switch assembly of claim 10, wherein the external rod extends above a lower wall of the switch frame.

13. The railroad switch assembly of claim 10, wherein the external rod is operatively connected to the switch foot such that the external rod extends within an opening of the switch foot, the external rod being free to move within the opening along the length of the stock rail relative to the switch foot, the external rod being free to move within the opening vertically relative to the stock rail.

14. The railroad switch assembly of claim 10, wherein the operative connection of the external rod between the switch foot and the point detection rod has less than two points of loss.

15. The railroad switch assembly of claim 10, wherein the external rod extends within the switch frame.

16. A railroad switch circuit controller assembly comprising:

a switch frame configured to be mounted to a stock rail;

a switch controller held by the switch frame, the switch controller comprising at least one switching mechanism, the switch controller comprising a point detection rod operatively connected to the at least one switching mechanism;

a switch foot configured to be mounted to a switch rail, wherein the switch foot comprises a slot having a length that is configured to extend along a length of the stock rail when the switch frame is mounted to the stock rail; and an external rod operatively connected between the switch foot and the point detection rod of the switch controller such that the external rod is configured to translate linear movement of the switch foot toward and away from the stock rail to the point detection rod, the external rod being operatively connected to the switch foot such that the external rod extends within the slot, wherein the external rod extends within an interior cavity of the switch frame and the external rod is free to move within the slot along the length of the slot.

17. The railroad switch circuit controller assembly of claim 16, wherein the external rod is configured to extend above a lower wall of the switch frame when the switch frame is mounted to the stock rail.

18. The railroad switch circuit controller assembly of claim 16, wherein the switch foot comprises an opening, the external rod being operatively connected to the switch foot such that the external rod extends within the opening, wherein the external rod is free to move vertically within the opening relative to the switch foot.

19. The railroad switch circuit controller assembly of claim 16, wherein the operative connection of the external rod between the switch foot and the point detection rod has less than two points of loss.

20. The railroad switch circuit controller assembly of claim 16, wherein the switch frame is configured to be mounted to the stock rail using a clamp, the switch frame further comprising a wedge retainer that is fit over a clamping member of the clamp with an interference fit.

* * * * *